United States Patent [19]

Rush

[11] 4,193,148

[45] Mar. 18, 1980

[54] TRANSPARENT RADIATION PENETRABLE STRETCHER PANEL

[76] Inventor: Charlie D. Rush, Rte. 4, Box 324E, Albany, Ga. 31701

[21] Appl. No.: 935,626

[22] Filed: Aug. 21, 1978

[51] Int. Cl.[2] ..... A61G 7/10

[52] U.S. Cl. ..... 5/86; 5/82 R; 250/439 R

[58] Field of Search ..... 5/62, 66–69, 5/81 R, 82, 86; 250/439, 444 R

[56] References Cited

U.S. PATENT DOCUMENTS

| | | | |
|---|---|---|---|
| 2,681,839 | 6/1954 | Limbach | 5/86 |
| 2,904,798 | 9/1959 | Heflin | 5/308 |
| 2,989,634 | 6/1961 | Ould et al. | 250/444 |
| 3,188,659 | 6/1965 | Lundgren et al. | 5/86 |
| 3,344,446 | 10/1967 | Tritt | 5/92 |
| 3,503,082 | 3/1970 | Kerwit | 5/66 |

*Primary Examiner*—Casmir A. Nunberg

*Attorney, Agent, or Firm*—Newton, Hopkins & Ormsby

[57] ABSTRACT

A patient support panel for a stretcher is formed of transparent material which is also X-ray penetrable. A marginal support frame for the panel can be detachably supported on a wheeled stretcher carriage. An X-ray film holder is suspended adjustably from the marginal support frame and a traction pulley assembly can be selectively mounted at either end of the panel support frame.

9 Claims, 4 Drawing Figures

TRANSPARENT RADIATION PENETRABLE STRETCHER PANEL

BACKGROUND OF THE INVENTION

Victims of automobile accidents and the like are usually picked up at the scene of the accident by an emergency crew and placed on a backboard or conventional ambulance stretcher for transporting to a hospital emergency room. At the hospital, the patient is usually transferred to another examining table and if X-rays are required, the patient may be wheeled on still another stretcher to an X-ray department and placed on an X-ray examination table. In the case of some spinal injuries and other types of injuries, these movements of the patient from one support structure to another can aggravate the injury in lesser or greater degrees.

With the above prior art practices in mind, it is the object of the present invention to provide a stretcher on which an injured patient can be placed at an accident scene for transportation directly to an X-ray department or facility where X-ray pictures of the patient can be taken without transferring the patient from the stretcher. To facilitate this, the stretcher possesses a patient support panel or backboard which is both transparent to light in the visual spectrum and permeable to X-ray radiation. Thus, a patient resting on the stretcher panel can be viewed from beneath the panel due to its transparency and an X-ray film positioned on an underslung holder beneath the panel can be exposed to radiation from above the stretcher passing through the patient and the permeable stretcher panel. The support panel, with its marginal frame, is detachably mounted on the under-carriage of a generally conventional stretcher, and attachments are provided on the stretcher for applying traction to a patient thereon.

Other features and advantages of the invention will become apparent during the course of the following description.

DETAILED DESCRIPTION

Figure 1:
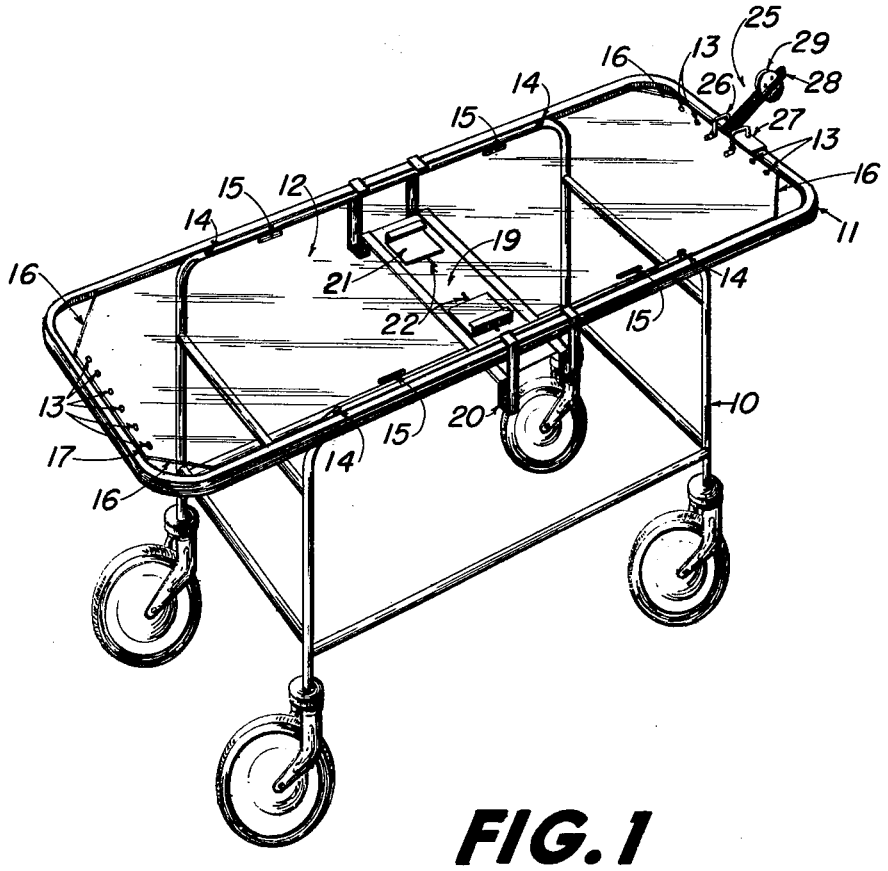
FIG. 1 is a perspective view of a stretcher including a patient support panel and X-ray film holder according to the invention.

Referring to the drawings in detail wherein like numerals designate like parts, the numeral 10 designates a wheeled lower frame for a stretcher which also includes an upper horizontal generally rectangular perimeter frame 11 preferably having rounded corners, as shown. Within the confines of the horizontal rigid frame 11 is positioned a taut patient support panel 12 or backboard formed of flexible plastics material which is permeable to light in the visual spectrum, and therefore transparent, and also permeable or penetrable to X-rays. Such plastics materials are readily available on the open market and one such material is manufactured and sold under the trademark TUFFAX.

Figure 2:
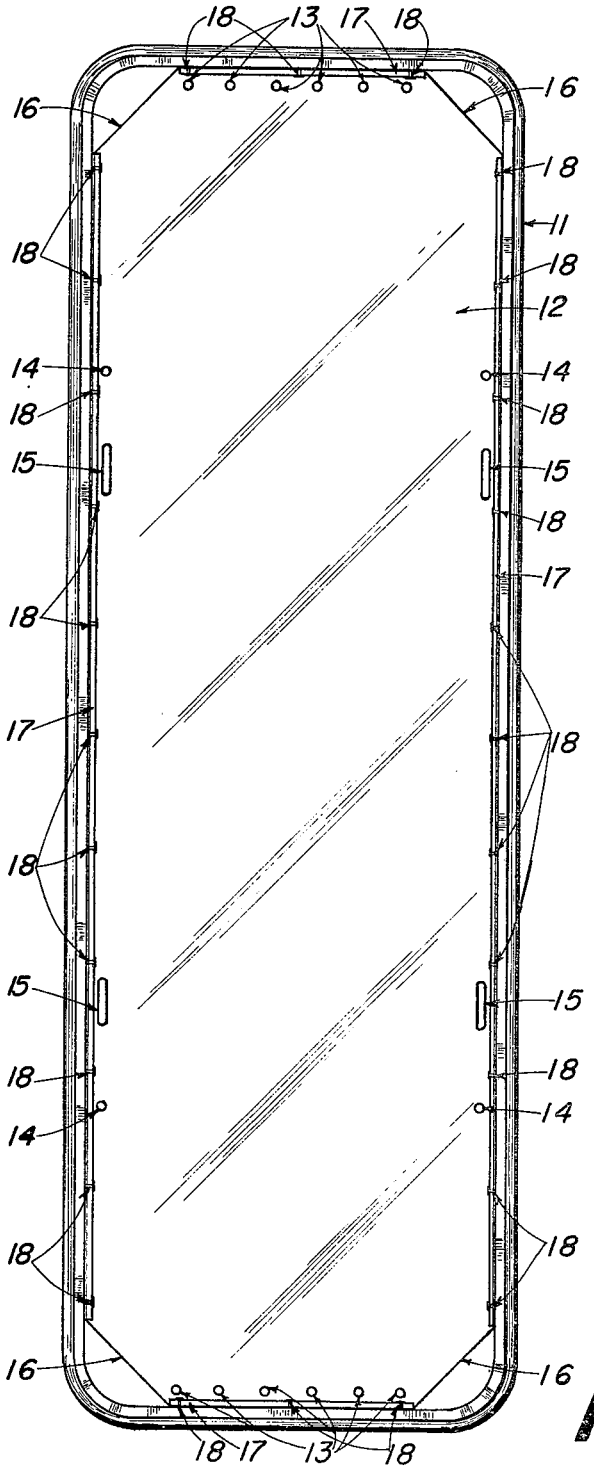
FIG. 2 is a bottom plan view of the stretcher support panel and associated elements, parts omitted.

The support panel 12 has marginal downturned edge portions 17 along the sides and ends thereof secured preferably at intervals to the frame 11 by pop rivets 18. Strap receiving slots 15 are preferably provided in the patient support panel 12, as shown, and peg apertures 14 are also formed through the panel 12, FIG. 2, to receive pegs rising from opposite sides of the lower frame 10 by means of which the horizontal frame 11 is tiltably and detachably mounted on the lower frame. The four corners of the panel 12 are cut diagonally as shown at 16 to provide ready hand grips at the corners of the frame 11 for lifting such frame with the support panel 12 off of the base or lower frame 10.

Figure 3:
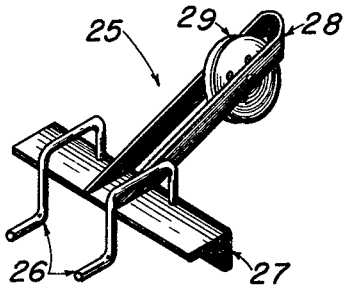
FIG. 3 is a perspective view of a traction pulley assembly.
Figure 4:
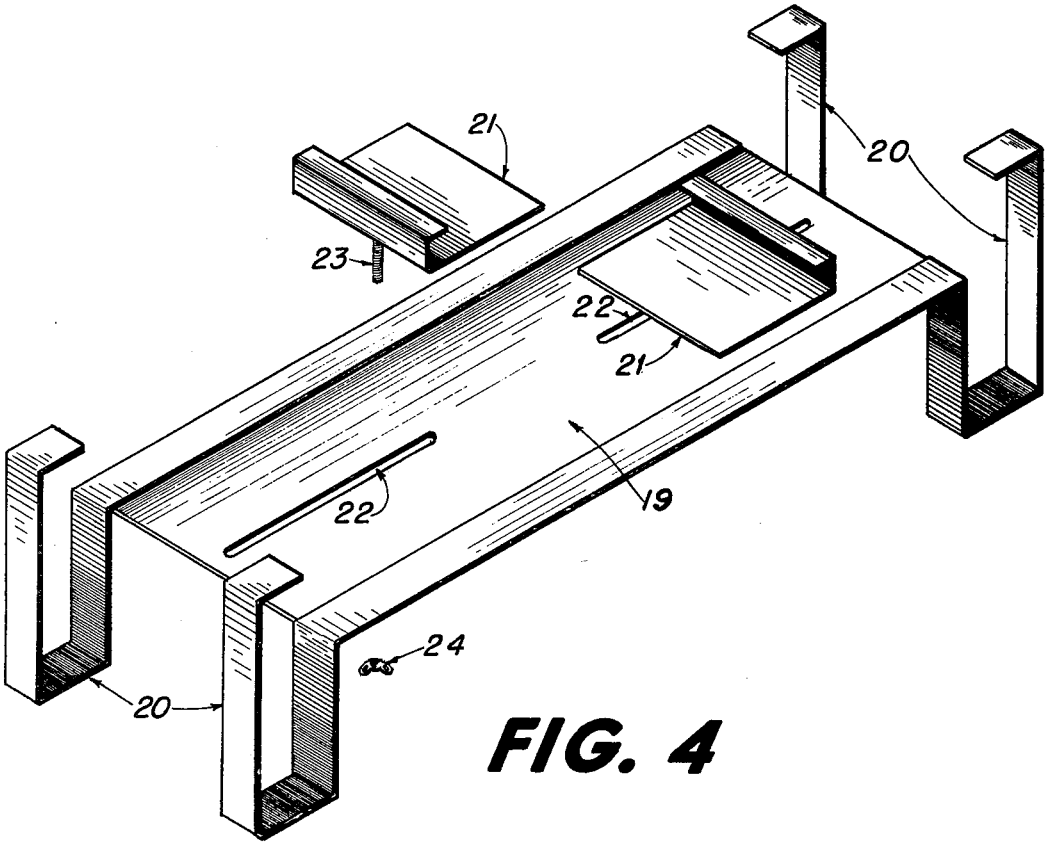
FIG. 4 is an exploded perspective view of an X-ray film holder assembly used in conjunction with the stretcher.

The panel 12 is further provided along and near its opposite ends with spaced apertures 13 to facilitate the mounting of a traction pulley assembly 25, FIG. 3, at either end of the panel 12, as illustrated in FIG. 1. The pulley assembly 25 comprises an angle bar mounting base 27 which rests on either end bar of the frame 11 during use. A pair of inverted U attachment legs 26 carried by the element 27 are insertable through selected apertures 13 of the panel 12 to mount the assembly 25 at the desired lateral location on the stretcher. The assembly 25 further includes an inclined pulley boom 28 and a traction pulley 29 journaled thereon.

To facilitate using the stretcher as an emergency X-ray examination table without transferring the patient to another table, an underslung X-ray film holder or tray 19 is suspended from the frame 11 by hanger arms 20 at each end thereof which slidably engage the side bars of frame 11, thus enabling the film holder 19 to be easily adjusted longitudinally of the transparent and X-ray permeable support panel 12. The holder 19 is disposed horizontally at an elevation below the panel 12 and extends transversely of the panel as shown in FIG. 1 so that a patient on the panel 12 is positioned between an overhead X-ray source, not shown, and an X-ray film, not shown, on the holder 19.

The film holder 19 has a pair of adjustable film clamps 21 having depending studs 23 which ride in slots 22 on the holder 19. The clamps 21 are secured in adjusted positions by wing nuts 24 which receive the threaded studs 23 below the slots 22 of the holder.

The invention possesses a number of important features including the following:

(1) The panel 12 can be seen through and thus allows viewing the underside of a patient on the stretcher without lifting or turning the patient.

(2) X-rays can penetrate the support panel 12 without appreciable distortion.

(3) An image intensifier can be used under the panel 12.

(4) The panel 12 and attached horizontal frame 11 can be separated from the lower frame 10 of the stretcher so that a patient can be placed on another examining table, such as an X-ray table, without moving the patient from the panel 12.

(5) The entire stretcher can be transported on an emergency vehicle to the scene of an accident where the patient is placed on the panel 12 and remains thereon without movement, if desired, until X-ray examination is completed.

(6) Traction can be applied to either leg or to the spine from either end of the support panel.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a patient support device, a light transparent and x-ray penetrable flexible patient support panel, and a relatively rigid marginal frame surrounding said panel and secured thereto for holding said panel taut, said frame defining means by which the device can be placed on a wheeled stretcher carriage and lifted therefrom for placement on an examining table appreciably without disturbing a patient on said panel.

2. In a patient support device as defined in claim 1, and an X-ray film holder removably suspended from said marginal frame and disposed in spaced relationship beneath said support panel in spaced relation thereto.

3. In a patient support device as defined in claim 2, and said film holder having suspension arms engaging opposite sides of said marginal frame and being adjustable therealong lengthwise of such frame and the patient support panel.

4. In a patient support device as defined in claim 3, and adjustable X-ray film clamping means on said film holder.

5. In a patient support device as defined in claim 1, and a traction pulley assembly adapted for mounting selectively on the transverse portion of either end of said marginal frame.

6. In a patient support device as defined in claim 5, wherein said frame is rectangular and has transverse end frame bars, and the front and rear edge portions of said panel are provided with locator openings therethrough, and said pulley assembly includes a mounting bar adapted to rest on the upper surface of either of said end frame bars, and a pair of attaching elements carried by said mounting bar and engageable selectively in locator openings provided in the patient support panel.

7. A combined stretcher and x-ray examination table for emergency patients comprising in combination a wheeled stretcher base, an upper horizontal stretcher frame detachably secured to said base, and a light transparent and radiation penetrable patient support panel secured to and held taut within the confines of the upper stretcher frame and being liftable as a unit with said stretcher frame; whereby said patient may be visually observed through said panel.

8. A combined stretcher and x-ray examination table as defined in claim 7, and an adjustable x-ray film holder dependingly secured to said stretcher frame and extending transversely beneath and in spaced relationship to said panel for cooperation with an x-ray source above a patient on said support panel.

9. In a patient support device as defined in claim 1, said panel and said frame being rectangular and the corners of said panel being spaced from the corners of said frame sufficiently to provide openings through which the hands of persons may be inserted so as to grasp the frame by its corner portions.

* * * * *